US006066390A

United States Patent [19]

Quigley

[11] Patent Number: 6,066,390

[45] Date of Patent: May 23, 2000

[54] LOW PERMEABILITY SPIRAL FABRIC

[75] Inventor: Scott Quigley, Townville, S.C.

[73] Assignee: Wangner Systems Corporation, Greenville, S.C.

[21] Appl. No.: 09/037,080

[22] Filed: Mar. 9, 1998

[51] Int. Cl.[7] ..... D03D 13/00

[52] U.S. Cl. ..... 428/222; 162/289

[58] Field of Search ..... 162/289; 428/222

[56] References Cited

U.S. PATENT DOCUMENTS

| | | | |
|---|---|---|---|
| 4,467,839 | 8/1984 | Westhead | 139/383 |
| 4,490,925 | 1/1985 | Smith | 34/42 |
| 4,791,708 | 12/1988 | Smolens | 24/33 |
| 5,104,724 | 4/1992 | Hsu | 428/222 |
| 5,361,808 | 11/1994 | Bowen, Jr. | 139/383 |
| 5,364,692 | 11/1994 | Bowen, Jr. et al. | 428/222 |

*Primary Examiner*—Christopher Raimund
*Attorney, Agent, or Firm*—Pitney, Hardin, Kipp & Szuch LLP

[57] ABSTRACT

An endless dryer fabric having a paper fiber support surface and a machine contact surface arranged about drying drums within a drying machine. The support surface is adopted to allow air to pass there through while carrying paper forming fibers through the drying machine during drying. The fabric consists of a plurality of elliptically shaped coil monofilaments arranged side by side in intermeshing relationship with elongated pintles extending through the intermeshed portions of the coils forming the fabric continuous. An elongated stuffer filament having a cross-section selected from a rhomboid parallelogram, a rhombus parallelogram and a pointed ellipse is positioned to extend diagonally through central portions of each of said coils leaving diagonally opposed equal sized open areas within each coil. The stuffer filaments have opposed shaped edges which engage across the entire width of adjacent coil forming filaments forming secure closures against air passages along upper and lower opposed ends of the central portions. The stuffer filaments are positioned within each coil with its machine direction edge engaging below a connecting pintle and its trailing edge engaging above a connecting pintle.

13 Claims, 2 Drawing Sheets

LOW PERMEABILITY SPIRAL FABRIC

BACKGROUND OF THE INVENTION

The instant invention is directed to a coil link dryer fabric in which stuffers are inserted into open areas to reduce the porosity of the dryer fabric.

In general, dryer fabrics of this structure are known. U.S. Pat. Nos. 4,490,925 and 5,364,692 are two such structures in which the porosity or permeability has been reduced from about 900 CFM to about 450 CFM. These fabric structures are not completely satisfactory due to uneven porosity created when in use in the dryer section.

In FIG. 1 there is shown a schematic sectional drawing of a dryer fabric A carrying a sheet of paper forming fibers B through a dryer section of a paper forming machine. As dryer fabric A passes first over and then beneath heated rolls C and D fluid is removed from fibers B and passes through the dryer fabric. It has been found that as the dryer fabric passes beneath heated rolls D, the rolls assist in holding fibers B smoothly and firmly against the dryer fabric as is desired. However, when passing over heating rolls C a certain amount of air is pushed upward from rolls C through the paper forming fibers. Should passage of this air be uneven due to uneven porosity of the dryer fabric or due to uneven air pockets having been formed, there is a danger of certain ones of the fibers being separated from the dryer fabric causing uneven drying and in some cases creases in the fiber sheet.

To this end, it is an object of the invention to provide a coil link dryer fabric of reduced and even porosity.

Another object of the invention is to provide a coil link dryer fabric with a shaped stuffer filling selected areas of the inner space of the coils.

Another object of the invention is to provide a dryer fabric of coil link construction which controls its permeability more evenly during the drying operation.

Another object of the invention is the provision of a heat set coil link dryer fabric of uniform stability and porosity.

SUMMARY OF THE INVENTION

The instant invention is directed to a stuffed spiral link dryer fabric of a prescribed width and reduced permeability. The fabric consists of a plurality of shaped continuous filaments forming symmetrical elliptical spiral link members which are intermeshed end to end. An elongated pintle member is positioned to extend through the intermeshed portions of adjacent spiral members interconnecting them and creating a spaced open area between the ends. An elongated shaped monofilament stuffer member is positioned to extend diagonally through each of the open areas.

The stuffer filaments are shaped to have first and second edges with a first of these edges being located above a first of the pintles in contact with the outer surfaces of the filament passing there around. The second of these edges is located below a second of the pintles in contact with the outer surfaces of the filaments passing there around. The first and second edges are in contact with the horizontal outer surfaces of each of the filaments evenly across their entire width.

The stuffer filament may have a cross-section which is a rhomboid parallelogram or a rhombus parallelogram or a pointed ellipse. The positioned stuffer forms diagonally opposed equal open areas within the cavity of each coil link. Each stuffer is positioned in the open areas with their lower edge directed in the machine direction.

A papermaking fabric formed of interconnected coiled filaments having a paper fiber support surface and a machine contact surface for use in a papermaking machine. The fabric comprises a plurality of filaments shaped into elliptically shaped coils arranged side by side with end portions intermeshing. The coil forming filaments have planar outer surfaces. A plurality of elongated pintles are positioned to extend through the intermeshed portions of adjacent coils forming the fabric continuous for movement about the papermaking machine.

A stuffer is positioned to extend through the central portion of each of the coils to engage across the entire width of the outer surfaces of the forming filaments. The stuffer is shaped to form diagonally opposed upper and lower open areas within each central portion.

Stuffer filaments have a cross-sectional shape selected from one of a rhomboid parallelogram, a rhombus parallelogram, and a pointed ellipse. These filaments are synthetic material selected from one of PEEK, PCTA, PPS, and PET.

DESCRIPTION OF A PREFERRED EMBODIMENT

Figure 2:
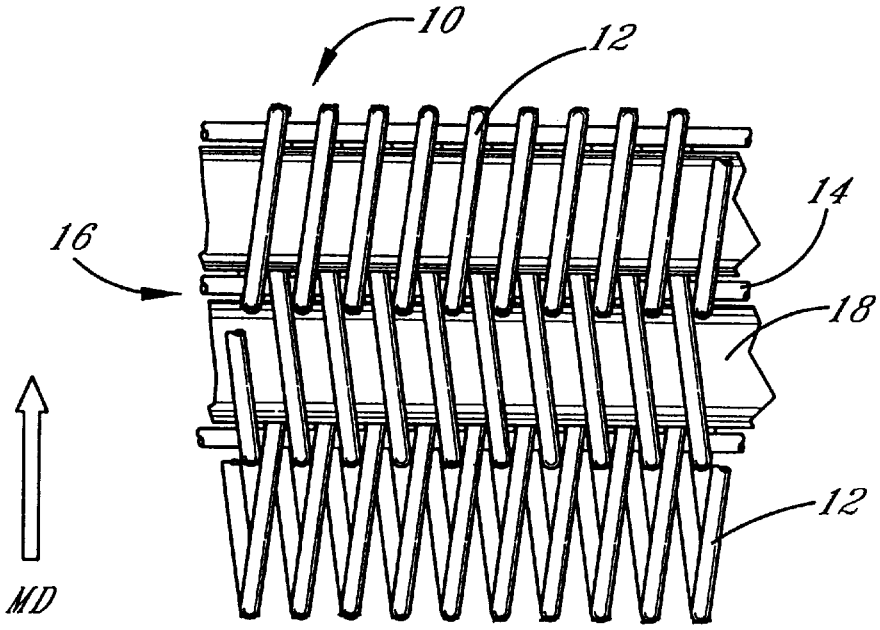
FIG. 2 is a sectional top view of the coil link fabric of the invention.
Figure 3:
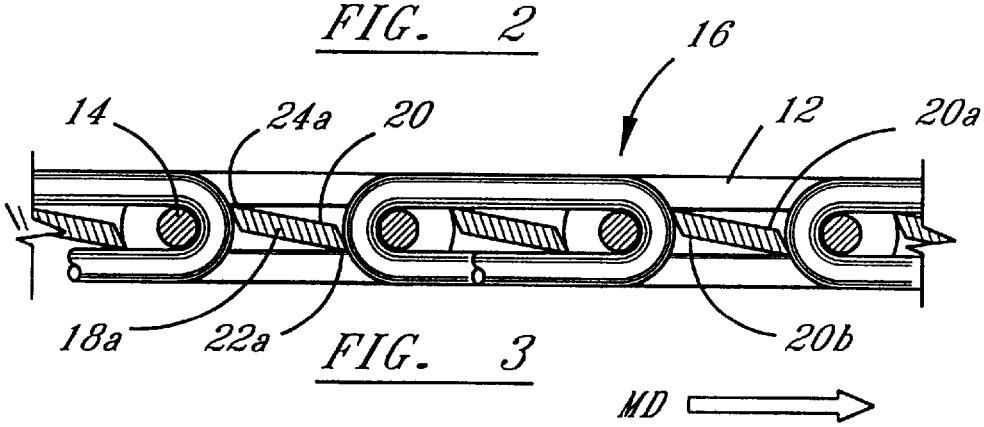
FIG. 3 is a sectional side view of a first embodiment of the stuffer as employed with the coil link fabric of the invention.

Turning now to FIGS. 2 and 3, a top sectional view of the coil link dryer fabric of the invention is shown at 10. A plurality of transversely extending, intermeshed coil links 12 are shown inter-engaged or linked together with transversely extending pintles 14. A stuffer 18 is disposed in the opening 20 formed between adjacent pintle engagements. The points where pintles 14 engage coil links 12 comprise pivot points 16. After assembly, dryer fabric 10 is heat treated at between 500° F. and 550° F. which produces controlled shrinkage which sets or locks the forming filaments in their relative positions.

Coil links 12 are shaped elliptically which causes opening 20 to be formed substantially rectangular. In order to substantially fill the openings created through fabric 12 along openings 20 evenly, stuffers 18 are shaped to be wider than they are high. In order for the stuffer to fit snugly over or under the pintle 14 at pivot points 16 they are formed with a sharp edge at each side.

It is preferred that coils 12 and pintles 14 be formed of monofilaments formed of one of PEEK, PCTA, PPS, and PET although it is within the scope of the invention to form the coils of a first of the synthetic materials and the pintles of a second. Also, the monofilaments forming coils 12 are formed with a rectangular cross-section while pintles 14 are formed with a circular cross-section.

Figure 1:
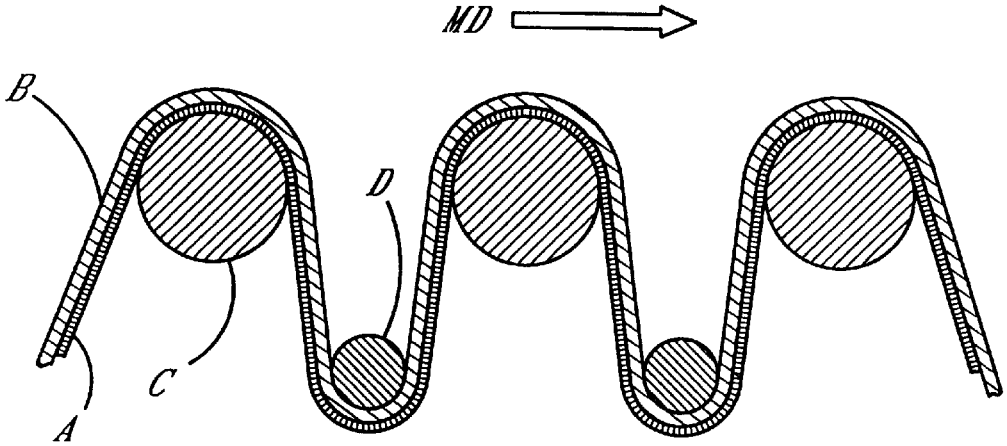
FIG. 1 is a schematic view of a dryer fabric passing about rolls of a dryer section.

Normally coil link dryer fabrics have a permeability of between 600–1000 CFM. Stuffer yarns are provided to limit the open area through the coils of the fabric and thereby reduce the permeability to around 175 CFM. While the stuffers reduce the permeability to this level, there have been problems with even air and liquid flow through the fabric, particularly as the fabric carrying the paper product passes over rolls C as shown in FIG. 1.

It has been found that by shaping stuffer 18 to have a cross-section shaped as a rhomboid parallelogram or a rhombus parallelogram or a pointed ellipse and arranging the stuffer in openings 20 with its machine direction edge disposed beneath pintle 14 that permeability below 175 CFM with even air and liquid flow can be had.

Turning now to FIG. 3, the dryer fabric of the invention is shown with stuffer 18 as having a rhomboid parallelogram cross-sectional shape. The machine direction edge 22 is shown engaging the filaments forming coils 12 beneath the axial position of pintle 14. The opposite edge 24*a* of stuffer 18*a* is shown engaging the filaments forming coils 12 above pintle 14. Stuffer 18 forms a pair of diagonally opposed open areas 20*a* and 20*b* in open areas 20.

Figure 6:
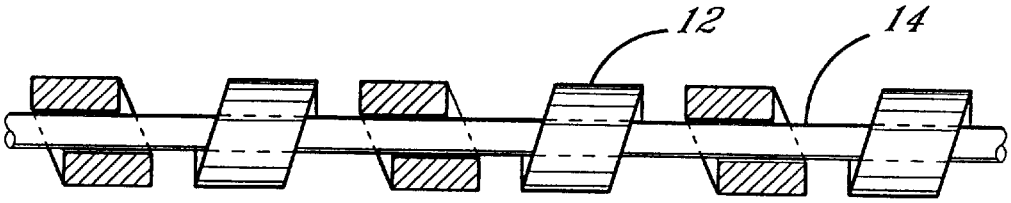
FIG. 6 is a sectional end view showing the cross-section of the coil forming filaments.
Figure 7:
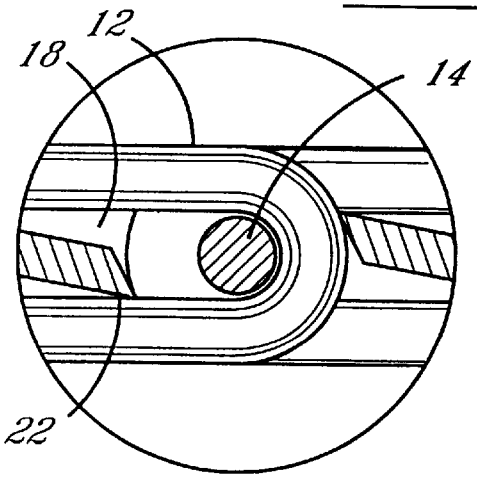
FIG. 7 is an exploded sectional side view showing the relationship of the coil forming filament, the pintle and the stuffer.
Figure 8:
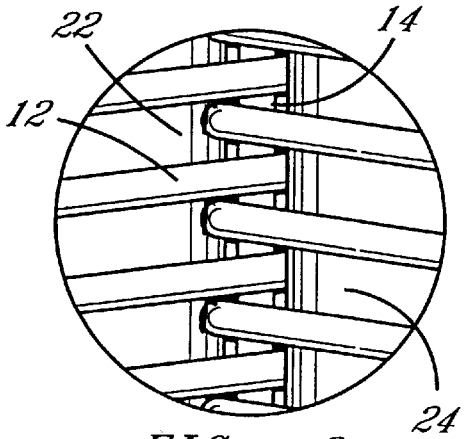
FIG. 8 is an exploded sectional top view similar to FIG. 6.

Turning now to FIGS. 6, 7, and 8 which are detailed views showing the shaped rectangular configuration of the filaments forming coils 12 as they engage about pintle 14. It is noted that the upper and lower surfaces of these filaments remain disposed along a substantially parallel plane across the fabric. This surface provides an area which may be contacted or engaged evenly across the entire width of the filament by outer edge 22 or 24 of stuffer 18. This continuous even contact produces an even seal which provides more even air passage and drainage over the width and along the length of the dryer fabric.

FIGS. 6 and 7 show in detail, lower edge 24 engaging with the outer surface of the filament forming the machine direction coil 12 and beneath pintle 14.

Figure 4:
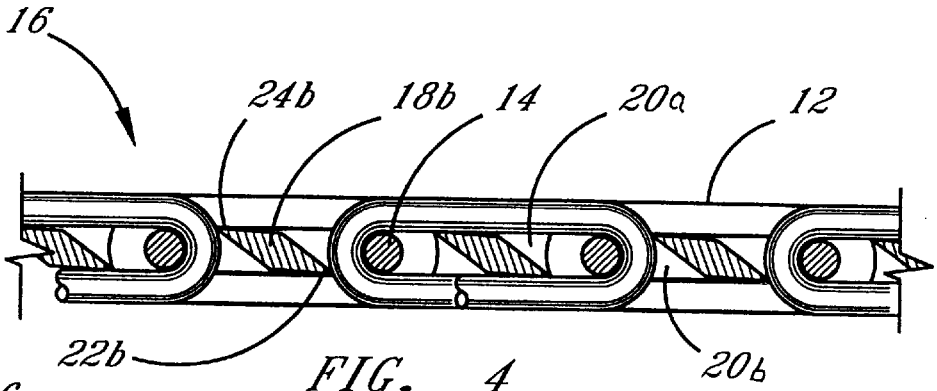
FIG. 4 is a sectional side view of a second embodiment of the stuffer as employed with the coil link fabric of the invention.
Figure 5:
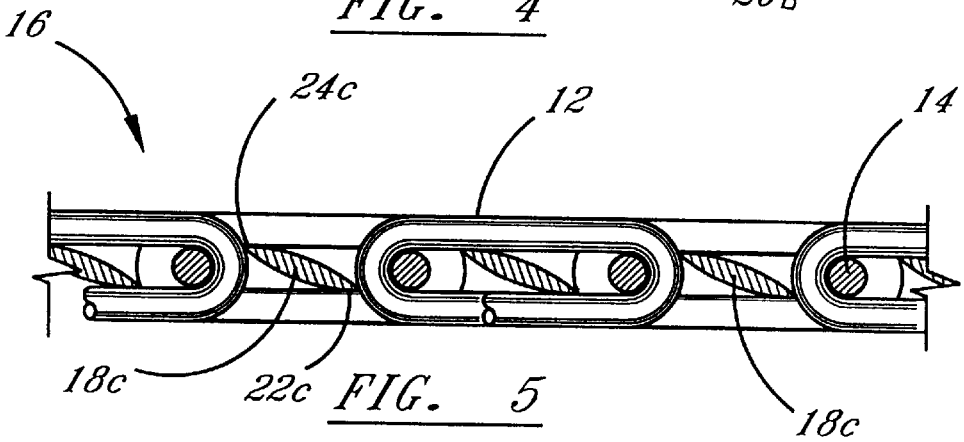
FIG. 5 is a sectional side view of a third embodiment of the stuffer as employed with the coil link fabric of the invention.

FIGS. 4 and 5 shows arrangements similar to that described in FIG. 3. In FIG. 4, stuffer 18*b* has a cross-section with a rhombus parallelogram shape while the fabric shown in FIG. 5 has a stuffer 18*c* with cross-section having a pointed ellipse shape. Each of the stuffer filaments 18*a*, 18*b*, and 18*c* are constructed with sharp or pointed edges 22*a*, 24*b*; 22*a*, 24*b*; 22*c*, 24*c* which are positioned with the lower edge being disposed in the machine direction and arranged beneath the pintle 14 at pivot 16. Each of the upper edges are disposed above the trailing pintle 14.

Each of stuffers 18*a*, 18*b*, and 18*c* when disposed in opening 20 create diagonally disposed open area 20*a*, 20*b* with area 20*a* being formed above stuffer 18 and adjacent the support surface of the dryer fabric. The shape of stuffers 18*a*, 18*b*, and 18*c* is such that diagonally disposed openings 20*a*, 20*b* are equally sized.

It is noted that the invention is not limited to the exact stuffer shapes illustrated so long as the stuffers are formed with upper and lower edges which engage over and under the opposed pintles and form diagonally opposed open areas of equal size.

After forming fabric 10 is subjected to heat treating which causes controlled shrinkage and also stabilizes the fabric. This is a well known procedure better described in U.S. Pat. No. 5,104,724 which disclosure is herein incorporated.

In operation, paper forming fibers are disposed on and engaged with the support surface of dryer fabric A as it moves through the dryer section in the direction of arrow MD. The fabric is exposed to intense heat in the range of 500° F. to 700° F. as the moisture is removed from the paper fibers. As the fabric passes over rollers C it is important that heat and air moving through the open areas of the fabric be even so as to not disengage the paper fibers from the dryer fabric. The structure as described provides porosity in the dryer fabric which produces improved and satisfactory results.

While a preferred embodiment of the invention has been described using specific terms, such description is for illustrative purposes only, and it is to be understood that changes and variations may be made without departing from the spirit or scope of the following claims.

What is claimed is:

1. An endless dryer fabric having a paper fiber support surface and a machine contact surface arranged about drying drums within a drying machine, said support surface being adopted to allow air to pass there through while carrying paper forming fibers through said drying machine during drying, said fabric comprising;

a plurality of elliptically shaped coil monofilaments arranged side by side in intermeshing relationship and elongated pintles extending through intermeshed portions of said coils forming said fabric continuous;

elongated stuffer filaments, having a cross-section selected from one of a rhomboid parallelogram, a rhombus parallelogram, and a pointed ellipse, extending diagonally through central portions of each of said coils leaving diagonally opposed equal sized open areas within each coil, said stuffer filaments having opposed shaped edges which engage across the entire width of adjacent coil forming filaments forming elongated secure closures against air passage along upper and lower opposed ends of said central portions; whereby, air passage through said dryer fabric is equalized throughout its passage through said drying machine allowing even drying and preventing flutter of said paper forming fibers.

2. The coiled fabric of claim 1 wherein a first of said shaped edges extend in the machine direction said first of said shaped edges engaging with coil filaments beneath said pintles.

3. A stuffed spiral link fabric of prescribed width and reduced permeability for use in a papermaking machine consisting of:

a plurality of shaped continuous filaments comprising symmetrical elliptical spiral links intermeshed end to end;

elongated pintle members extending through said intermeshed portions of adjacent spiral links interconnecting said spiral links creating spaced open areas between said ends;

elongated shaped monofilament stuffer members, having an edge at each side thereof, extending diagonally through said open areas with a first of said edges located above a first of said pintles in contact with outer surfaces of said filaments passing there around and a second of said edges located below a second of said pintles in contact with outer surfaces of said filaments passing there around, said stuffer forming symmetrical diagonally opposed open areas within the remainder of said open area.

4. The coiled fabric of claim 3 wherein said first and second edges contact each of said filaments evenly across its width.

5. The coiled fabric of claim 3 wherein said stuffer filament has a rhomboid parallelogram shaped cross-section.

6. The coiled fabric of claim 3 wherein said stuffer filament has a rhombus parallelogram shaped cross-section.

7. The coiled fabric of claim 3 wherein said stuffer filament has a pointed ellipse shaped cross-section.

8. The coiled fabric of claim 3 wherein said second edge of said stuffer filament is positioned to extend in the machine direction.

9. A papermaking fabric formed of interconnected coiled filaments having a paper fiber support surface and a machine contact surface for movement through a papermaking machine comprising;

a plurality of filaments forming elliptically shaped coils arranged sided by side with end portions intermeshing, said filaments having planar outer surfaces;

a plurality elongated pintles extending through said intermeshed portions of adjacent of said coils forming said fabric continuous for movement about said papermaking machine;

a stuffer extending through a central portion of each of said coils, engaging across the entire width of outer surfaces of each of said filaments forming said coils forming diagonally opposed upper and lower open areas within said central portion; whereby, air flow and permeability of said papermaking fabric is evenly and effectively restricted.

10. The fabric of claim 9 wherein said stuffer filaments have a cross-sectional shape selected from one of a rhomboid parallelogram, a rhombus parallelogram and a pointed ellipse.

11. The fabric of claim 9 wherein said filaments forming said dryer fabric are selected from one of PEEK, PCTA, PPS, and PET.

12. The fabric of claim 9 wherein first of said open areas, relative said direction of movement, are adjacent said support surface and second of said open areas are adjacent said machine surface, said open areas acting to equalize air pressure against paper fibers on said support surface during passage through said papermaking machine.

13. The fabric of claim 9 wherein said papermaking fabric is heat-set securing said coils, stuffers and pintles in fixed relative positions.

* * * * *